United States Patent [19]

Leake

[11] Patent Number: 4,984,999

[45] Date of Patent: Jan. 15, 1991

[54] STRING OF LIGHTS SPECIFICATION

[76] Inventor: Sam S. Leake, 4421 Lorraine Ave., Dallas, Tex. 75205

[21] Appl. No.: 524,468

[22] Filed: May 17, 1990

[51] Int. Cl.[5] ..... H01R 4/24

[52] U.S. Cl. ..... 439/425

[58] Field of Search ..... 439/110–115, 439/425, 502

[56] References Cited

U.S. PATENT DOCUMENTS

| | | | |
|---|---|---|---|
| 671,338 | 4/1901 | Halford . | |
| 672,639 | 4/1901 | Halford | 439/425 |
| 1,117,650 | 11/1914 | Erlanger | 439/425 |
| 1,745,133 | 1/1930 | Wermine | 439/425 |
| 2,062,752 | 12/1936 | Kindberg . | |
| 2,131,884 | 10/1938 | Brodhecker . | |
| 2,254,280 | 9/1942 | Gottheimer . | |
| 2,942,224 | 6/1960 | Messing . | |
| 3,107,061 | 10/1963 | Morgan . | |
| 3,527,933 | 9/1970 | Thommel . | |
| 4,744,766 | 5/1988 | Hall et al. . | |

*Primary Examiner*—Joseph H. McGlynn

*Attorney, Agent, or Firm*—James C. Fails; Arthur F. Zobal; Geoffrey A. Mantooth

[57] ABSTRACT

A string of lights characterized by a plurality of electrical conductors having their soft penetrating insulating material thereabout penetrated by sharpened ends of conductors connected with light emitting diodes spaced along a string of the elongate conductors. A low voltage transformer is also disclosed for electrically biasing the light emitting diodes.

12 Claims, 1 Drawing Sheet

STRING OF LIGHTS SPECIFICATION

FIELD OF THE INVENTION

This invention relates to low power consumption string of lights.

DESCRIPTION OF THE PRIOR ART

The prior art has seen the development of a wide variety of approaches to forming a string of lights, as for showrooms, Christmas trees and the like. A preexamination search turned up the following patents pertaining to this invention.

U.S. Pat. No. 671,338 describes a glow light that has its conductors d (spiked) pushed into electrical circuit bb.

U.S. Pat. No. 2,062,752 describes electrical conductors with a conductor tapped in along a line of flat electrical conduit at any point.

U.S. Pat. No. 2,131,884 describes an electrical plug having a large central opening with prongs that can be made to give electrical continuity when plugged thereinto by way of a plug.

U.S. Pat. No. 2,254,280 describes an electrical distribution system in which a plug end has laterally extending conductors that can be put into electrical contact to form a circuit.

U.S. Pat. No. 2,942,224 describes an electrical receptacle which has concealed conduits with lips to be contacted. The receptacle is rotatable to make electrical contact and receive a plug.

U.S. Pat. No. 3,107,061 shows a vehicle lighting system in which a permanently mounted flat tape conductor can have lights placed as desired and rotatable to establish contact.

U.S. Pat. No. 3,527,933, describes a light that has contact ends for contacting electrical conductors. The latter can have receiving apertures 5, 6, if desired.

U.S. Pat. No. 4,744,766, has a low voltage extended area for electrical contact by poking a contact pin 44 through hole 64 to contact electrodes 18. Other conductors in the form of grid 16 may be contacted by clip 62 (or the like). A rotatable member 28 ensures electrical contact.

From the foregoing it can be seen that the prior art fails to provide an economically easily obtained string of lights that has lower power consumption and that has no danger of shocking the user.

SUMMARY OF THE INVENTION

Accordingly, it is an object of this invention to provide a string of lights that has one of the desirable advantages delineated hereinbefore and not heretofore provided.

It is an object of this invention to provide a string of lights that has substantially all of the advantages delineated hereinbefore and not heretofore provided by the prior art.

These and other objects will become apparent from the descriptive matter hereinafter, particularly when taken in conjunction with the appended drawings.

In accordance with one embodiment of this invention, there is provided a string of lights characterized by a plurality of elongate electrical conductors spaced adjacent each other at parallel spaced apart distances that are standard and surrounded by respective soft penetrable insulating material and electrically connected with a plug for plugging into an electrical conduit and a respective conductors with sharpened ends adapted to penetrate into the insulating material when pushed thereinto such the electrical continuity through the light emitting diodes is effected and a string of lights is formed. The electrical conductors are connected with the plug by way of a low powered transforming device such that there is no danger of electrical shock; of a fire caused by hot incandescent bulb; or of a short in a Christmas tree or other decorative material.

The light emitting diodes have their respective outer ends of their conductors twisted to a predetermined angle with respect to inner ends.

In another embodiment of the invention, there is formed a string of lights characterized by light emitting diodes that have their sharpened conductors, or prongs, pushed into the soft insulating material about the conductors to form a string of lights.

Also disclosed is a second embodiment of the invention in which the electrical conductors of the light emitting diodes have their outer ends not only pushed into the soft insulating material but twisted with respect to the inner ends such that it is difficult to remove the conductors of the light emitting diodes from contact with the electrical conductors.

Furthermore, the prongs of the LED can be soldered to the conductors, if desired.

DESCRIPTION OF PREFERRED EMBODIMENT

The light emitting diodes of this invention can be made to give off photons, or emit light, when connected with either alternating current or with pulsating direct current. Since the invention connected with alternating current is most easily accomplished and has the desired effect with respect to the eye which will retain an image for about a twentieth of a second, this is the embodiment that will be described in more detail hereinafter.

Figure 1:
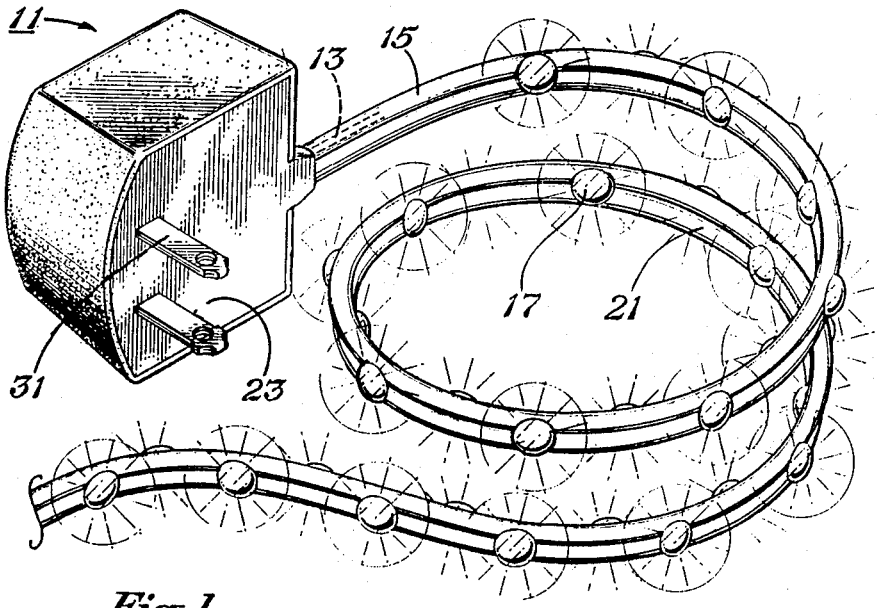
FIG. 1 is an isometric view of a string of lights in accordance with one embodiment of this invention.
Figure 2:
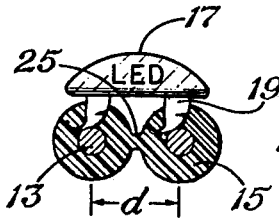
FIG. 2 is a cross-sectional view of the electrical conductors with the conductors from the light emitting diodes pushed into electrical continuity and in such a position with the electrical conductors surrounded by insulating material.

Referring to the figures and particularly FIG. 1, the string of lights 11 includes a plurality of elongate conductors 13, FIGS. 1 and 2, having respective soft penetrable insulating material 15 thereabout. The string 11 also includes a plurality of light emitting diodes 17 with their respective conductors pushed into the soft insulating material to form a string of lights.

In the string of lights, the conductors 13 are arranged predetermined standard distance apart. As illustrated, the distance d, FIG. 2 is the distance between the conductors of the light emitting diodes 17. The reason for this predetermined distance apart is such that the electrical circuit is completed when pointed conductors 19, FIG. 2, of the light emitting diodes 17 are pushed into electrical contact with a conductor 13, as through the insulating material 15.

Ordinarily, the string of electrical conductors may be in the form of an extension cord or the like in which the conductors, surrounded by the insulating material, are bound together to form a continuous string 21 in which the conductors are spaced apart a predetermined distance d. As illustrated, the electrical conductors are connected with a low powered transformer 23, FIG. 1 to give a low voltage output on the conductors. This prevents electrical shock and has other advantages which will be apparent from the descriptive matter hereinafter. Specifically, the insulating material surrounding the conductors may be fused together or may be fused by way of a web 25, FIG. 2.

The low voltage transformer 23 automatically will afford a low voltage alternating current in the range of from 6–24 volts. Low voltage transformers are well known and do not require detailed description herein. They simply employ a primary coil and a secondary coil to obtain the desired low alternating current. If desired, of course, this can effect a pulsating dc by sending the output through a unidirectional diode to give the desired result. As far as the light emitting diodes are concerned, they will emit photons, or visible light, regardless of the direction of the electromotive force thereacross, whether it be positive or negative.

The conductors are relatively standard and may be strands of copper wire or the like. In this embodiment, relatively small strands of copper wire may be employed and may go down to as small as 22 gauge wire. Ordinarily the string of lights will be in a range of 6–24 feet in length, preferably about 12 feet in length and have the desired attributes. Of course, a plurality of the light strings can be connected together without each of them requiring a low voltage transformer 23 if desired. Expressed otherwise, one string of lights may end in a negative receptacle for receiving a plug whereas an alternate string of lights may end in a plug for plugging into the negative receptacle so as to form a series connected string of lights.

Of course, across each of these series connected conductors in a string of lights, each LED is connected in parallel so one LED can fail to make a complete electrical circuit and it does not affect the others. It will show up merely as a non photon emitting LED.

Figure 3A:
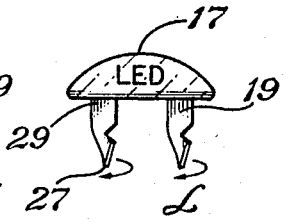
FIG. 3*a* shows an embodiment in which the conductors of the light emitting diodes are sharpened at their outer end and have their outer end twisted through a predetermined angle with respect to the inner end.

The electrical insulating material is ordinarily of soft rubber-like material and may be thermoplastic or it may be rubber such as Butyl rubber, Neoprene or the like. In any event, it is penetrable by sharpened conductors 19 on the LED's. The sharpened conductors 19, FIG. 3*a* may have their lower end snipped off at an angle to form a sharpened end 27. To keep the conductors in electrical contact with the respective electrical conductors 13 of the string 11, the lower ends may be twisted through a predetermined angle alpha.

Figure 3B:
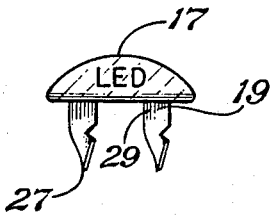
FIG. 3*b* shows another embodiment in which the light emitting diodes have their outer ends twisted through the predetermined angle with respect to the inner ends which are connected with the light emitting diodes.
Figure 4:
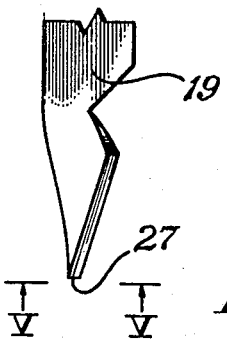
FIG. 4 shows an enlarged partial view of a LED conductor.
Figure 5:
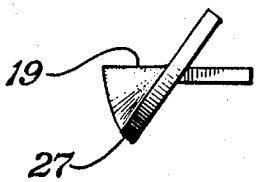
FIG. 5 shows a partial end view of a twisted conductor free end.

The angle alpha may be in the range of 45–60 degrees. As illustrated in FIG. 3*b*, each light emitting diode 17 has its conductors 19 the lower pointed ends 27 twisted with respect to the inner ends 29. As illustrated in FIGS. 4 and 5, each flat conductor 19 has its outer end twisted. The angle of twist is the preferred angle of alpha. FIG. 5 shows an end view of the twisted conductor. In this way the lower end of the light emitting diode conductors 19 can be pushed into electrical contact with the conductors 13 of the string 11 to form an electrical circuit through each of the respective light emitting diodes.

Light emitting diodes may be chosen to emit the color desired. For example, gallium arsenide is known to emit red light such that when electrically biased the photons that are emitted have energy equivalent to the energy range of red light. Thus, the photons that are perceived by the eyes are red. Other light emitting diodes can be chosen for the desired color. On the other hand, filters can be employed, for example with white light emitting diodes, to get the desired color. Filters should be chosen carefully, however, not to diminish the already low level or intensity, of emitted light.

In operation, a string of lights is formed by pressing the lower sharpened ends such as ends 27 of the conductors 19 of light emitting diodes 17 through the electrical insulating material 15 of the respective conductors 13 so as to form an electrical circuit that is complete through each light emitting diode 17. Responsive to being plugged in by way suitable plug 31, FIG. 1, light is emitted by light emitting diodes. In the illustrated embodiment, the light emitting diodes have relatively low voltage imposed thereacross. Specifically, the light emitting diodes, while they can take higher voltage, will emit photons at voltages low as about 5 volts so that 6 volts is adequate to impress across the light emitting diodes. When alternating current is used, the frequency by which light is emitted is 60 cycles per second. This enables the eye to hold the image for one twentieth of a second and still have light emitted before the eye returns to blackout condition. Thus, it is determined by the eye, the eye emitting diodes 17 will glow and if the eye is moved relative to the diodes, or otherwise, there is traced a path of this glow onto the retina of the eye. This gives a very pleasurable effect.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A string of lights comprising:

a. a plurality of elongate electrical conductor disposed adjacent each other at parallel, spaced apart a standard distance and surrounded by respective soft penetrable insulating material and electrically connected with a plug for plugging into an electrical circuit; and b. a plurality of light emitting diodes, having a plurality of respective conducting conductors connected for energization, said respective conductors having sharpened ends adapted to penetrate said insulating material when pushed thereinto; such that electrical continuity through said light emitting diodes is effected and a string of lights is formed when said light emitting diodes are pushed into electrical contact with said electrical conductors by having their sharpened end conductors pushed into electrical -continuity with said electrical conductors.

2. The string of lights of claim 1 wherein a low voltage transformer is employed and is connected with the conductors that are adjacent each other parallel spaced apart standard distance.

3. The string of lights of claim 1 wherein the length of the string of lights is in the range of 6–24 feet.

4. The string of lights of claim 1 wherein the length of the string of lights is about 12 feet.

5. The string of lights of claim 1 wherein said light emitting diodes have respective electrical conductors whose respective outer ends are twisted through a predetermined angle with respect their respective inner ends such that said electrical conductors are more difficult to pull out.

6. The string of lights of claim 5 wherein said predetermined angle is in the range of 45–60 degrees.

7. A string of lights comprising:

a. a plurality of elongated electrical conductors disposed adjacent each other parallel at standard predetermined spaced apart distances and surrounded by respective soft penetrable insulating materials and electrically connected with a plug for plugging into an electrical circuit; and b. a plurality of light emitting diodes having their respective conductors connected with sharpened ends that are pushed through said respective soft penetrable insulating material and into electrical contact with said electrical conductors; such that electrical continuity through said light emitting diodes is effected and a string of lights is formed.

8. The string of lights of claim 7 wherein a low voltage transformer is employed and is connected with the conductors that are adjacent each other parallel spaced apart standard distance.

9. The string of lights of claim 7 wherein the length of the string of lights is in the range of 6–24 feet.

10. The string of lights of claim 7 wherein said length is about 12 feet.

11. The lights of claim 7 wherein said light emitting diodes have their respective electrical conductors with outer ends that are in contact with the electrical conductors twisted to a predetermined angle with respect to the respective inner ends such that said electrical conductors are more difficult to pull out.

12. The lights of claim 11 wherein said predetermined angle is in the range of 45–60 degrees.

* * * * *